United States Patent [19]

Molinari

[11] Patent Number: 4,535,658

[45] Date of Patent: Aug. 20, 1985

[54] SOCKET BIT HOLDER

[75] Inventor: Paul J. Molinari, Manchester, Conn.

[73] Assignee: Allen Manufacturing Company, Bloomfield, Conn.

[21] Appl. No.: 354,137

[22] Filed: Mar. 5, 1982

[51] Int. Cl.[3] ..... B25B 23/16

[52] U.S. Cl. ..... 81/177.85; 81/438

[58] Field of Search ..... 81/177 G, 438

[56] References Cited

U.S. PATENT DOCUMENTS

| | | | |
|---|---|---|---|
| 2,667,194 | 1/1954 | Fischer et al. | 81/438 |
| 3,347,293 | 10/1967 | Clark | 81/438 |
| 3,935,762 | 2/1976 | Tudisco | 81/438 X |

*Primary Examiner*—James G. Smith

*Attorney, Agent, or Firm*—Stephen J. Rudy

[57] ABSTRACT

A socket bit holder formed with a circumferential groove in a bit holder opening of the socket, the holder arranged to receive a tool bit having peripheral notch means, and a split ring in the circumferential groove arranged to engage the notch means of the tool bit whereby the bit will be maintained in the holder.

3 Claims, 8 Drawing Figures

FIG. 4
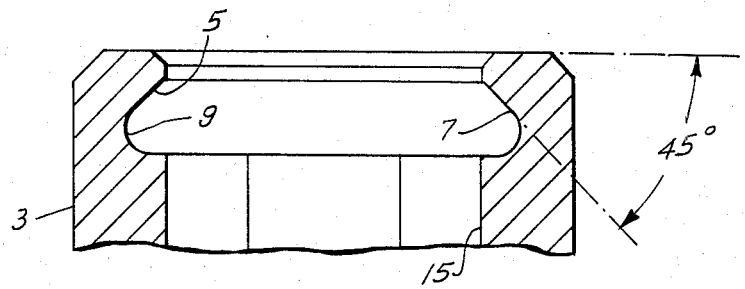
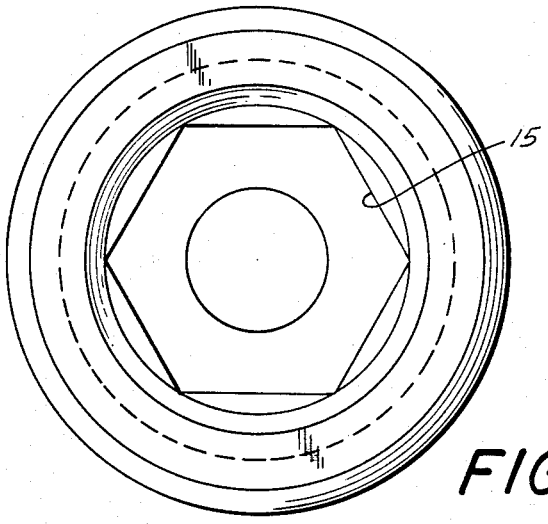
FIG. 5
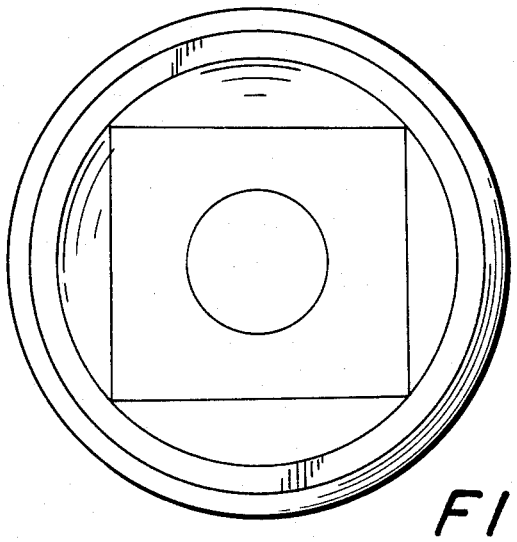
FIG. 6

FIG. 7
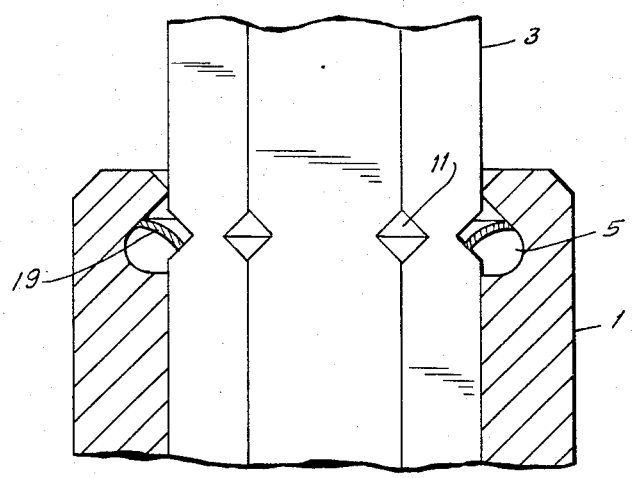
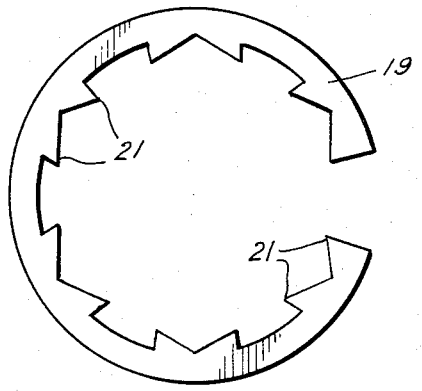
FIG. 8

SOCKET BIT HOLDER

BACKGROUND OF THE INVENTION

This invention relates to a socket bit holder arranged for receipt of a tool bit locked in the holder in a manner which prevents unintentional unlocking.

The usual bit holder in industrial use today will accomodate various types of tool bits, each of which may be readily disengaged from the holder. One shortcoming of such an arrangement is that the bit often will remain in the fastener when the holder is removed away from the fastener. Such a shortcoming is counter-productive when fasteners are to be set in assembly operations.

A primary object of the invention is to provide a socket bit holder which will hold a tool bit in locked position whereby the bit cannot be unintentionally removed from the holder.

Further objects and features will be apparent from the following description of the invention and the accompanying drawings wherein:

FIG. 4 is an enlarged section view showing details of a ring groove used in the socket of the bit holder of the invention;

FIG. 5 is a top view of the socket of FIG. 4;

FIG. 6 is a bottom view of the same;

FIG. 7 is a section view, similar in part to that of FIG. 3, but showing a second type of locking ring used in the socket bit holder of the invention and;

FIG. 8 is a plan view of the locking ring used in the embodiment of FIG. 7.

Figure 1:
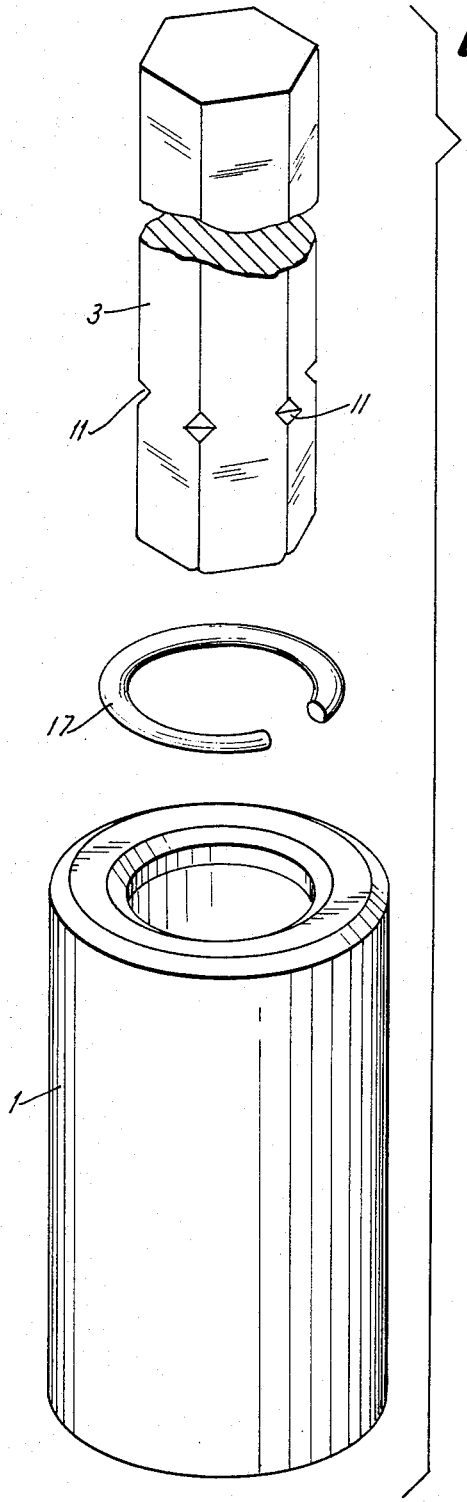
FIG. 1 is a view of the three components forming the bit holder of the invention, showing the components in disassembled condition.
Figure 2:
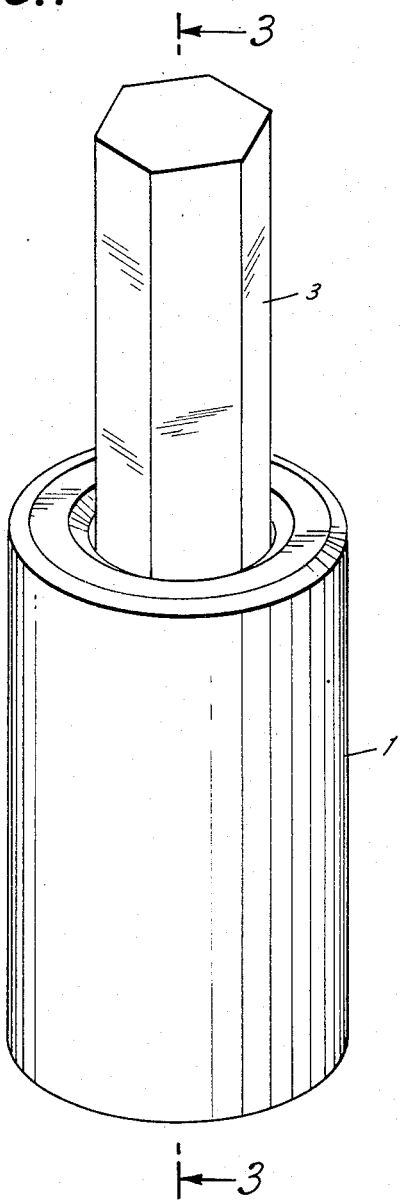
FIG. 2 is the same but showing the components in assembled condition.

Referring now to FIGS. 1 and 2, numeral 1 is a socket member which provides driving, i.e., rotary movement, to a tool bit 3, for the setting or unsetting of a fastener (not shown). The tool bit 3 illustrated is in the form of a hexagonal key, however, any other type of conventional fastener bit may be used. As seen in FIG. 4, a circumferential groove 5 is formed near the upper open end of the socket member, which groove has a side wall 7 formed with an angle of approximately 45° blending into a lower curved portion 9 of the groove. The tool bit 3 has a plurality of notches 11 around its periphery, arranged to coincide with the groove 5 when the tool bit is seated upon a bottom edge 13 of a tool bit receiving hole 15 is formed in the socket member 1, A split ring 17, i.e., conventional snap ring, positioned in the groove 5, engages the tool bit notches 11, to maintain the tool bit positioned in the socket 1.

Figure 3:
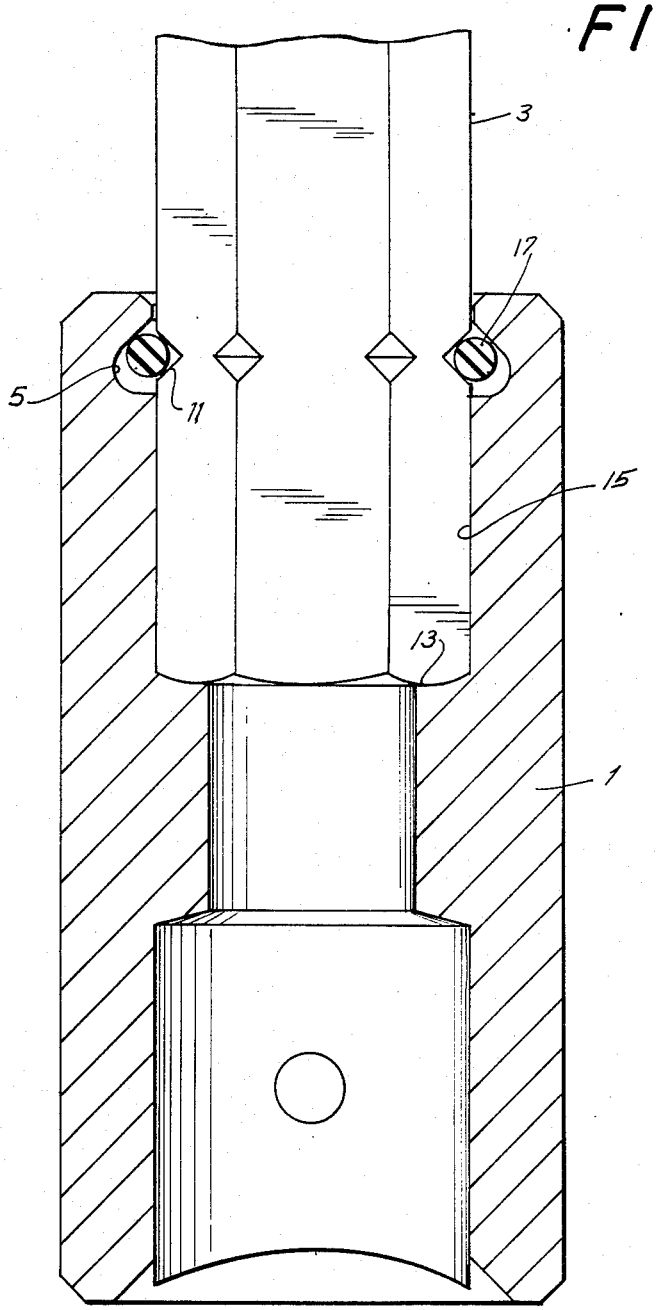
FIG. 3 is an enlarged section view as seen from line 3—3 in FIG. 2.

Axial force applied to the tool bit to remove it from the socket, will be frustrated because the cam angle (45°) of the side wall 7, will tend to lock the tool bit in the socket, as seen in FIG. 3. The tool bit may be removed from the socket when axial force is sufficient to expand the split ring sufficient 14 so that it moves into the curved portion 9 of the groove 5, and out of engagement with the tool bit notches 11. Such force may require the use of mechanical means since manual force would be insufficient, assuming that the split spring 17 has the required strength to resist expansion by manual force.

The socket bit holder embodiment disclosed in FIGS. 7 and 8, is the same in all respect to that above described except instead of a split ring 17, a split ring 19 is used. The ring 19, is flat and has a plurality of inwardly projecting teeth 21, as best seen in FIG. 8, which are bent downwardly approximately 15°. When the ring 19 is in holding position, as seen in FIG. 7, the tool bit 3 cannot be removed from the socket 1, without destruction of the ring 19.

A rubber "O" ring could, of course, be used which would retain the bit in the socket with enough force to maintain the connection but would allow relatively easy removal of the bit from the socket.

When using the socket bit holder of the invention for industrial use it would be most convenient to have as many different socket bit holder assemblies as needed to accomodate the various types of tool bits to be employed in assembly operations.

What is claimed is:

1. A socket bit holder comprising a socket member having a circumferential groove near one end of a tool bit opening formed in the socket member, said groove having a 45° surface tapering toward the end of the socket member, a tool bit adapted for insertion in the tool bit opening, a plurality of notches formed on the tool bit which notches are arranged to be adjacent the circumferential groove when the tool bit is in the socket member, and a resilient ring means positioned in the circumferential groove which ring is arranged to engage the tool bit notches.

2. A socket bit holder in accordance with claim 1, wherein the resilient ring means is a flat split ring having inwardly projecting teeth.

3. A socket bit holder in accordance with claim 2, said ring is metal and the inwardly projecting teeth are arranged at an angle approximately 15° relative to the plane of the flat portion of the split ring.

* * * * *